US008230523B2

(12) United States Patent
Chareyron

(10) Patent No.: US 8,230,523 B2
(45) Date of Patent: Jul. 31, 2012

(54) AMBIDEXTROUS MITT FOR TREATING A SURFACE

(76) Inventor: Frédéric Chareyron, Saint Etienne (FR)

( * ) Notice: Subject to any disclaimer, the term of this patent is extended or adjusted under 35 U.S.C. 154(b) by 986 days.

(21) Appl. No.: 11/884,864

(22) PCT Filed: May 9, 2006

(86) PCT No.: PCT/FR2006/001016

§ 371 (c)(1),
(2), (4) Date: Sep. 18, 2008

(87) PCT Pub. No.: WO2006/120330

PCT Pub. Date: Nov. 16, 2006

(65) Prior Publication Data

US 2009/0038098 A1 Feb. 12, 2009

(30) Foreign Application Priority Data

May 10, 2005 (FR) ..... 05 04668

(51) Int. Cl.
*A41D 19/00* (2006.01)

(52) U.S. Cl. ..... 2/161.6; 2/158; 2/160; 2/161.3; 15/1.52; 15/227

(58) Field of Classification Search ..... 2/16, 158, 2/161.6, 160, 161.3, 161.8, 164; 15/1.52, 15/227

See application file for complete search history.

(56) References Cited

U.S. PATENT DOCUMENTS

| | | | | | |
|---|---|---|---|---|---|
| 1,643,722 | A | * | 9/1927 | Millen | 15/227 |
| 1,782,502 | A | * | 11/1930 | Crane | 15/227 |
| 3,608,708 | A | * | 9/1971 | Storandt | 206/361 |
| 3,748,792 | A | | 7/1973 | Lamb | |
| 3,885,249 | A | | 5/1975 | De Brabander | |
| 4,959,881 | A | * | 10/1990 | Murray | 15/227 |
| 5,134,746 | A | * | 8/1992 | William | 15/227 |
| 5,715,841 | A | | 2/1998 | Utecht | |
| 5,956,770 | A | | 9/1999 | Dennis | |
| 6,145,155 | A | | 11/2000 | James et al. | |

FOREIGN PATENT DOCUMENTS

| | | |
|---|---|---|
| CH | 682 207 A5 | 8/1993 |
| FR | 2 242 044 | 3/1975 |
| FR | 2 588 728 | 4/1987 |
| FR | 2 864 751 | 7/2005 |
| GB | 2 260 889 A | 5/1993 |
| GB | 2 368 776 A | 5/2002 |

* cited by examiner

*Primary Examiner* — Alissa Tompkins
(74) *Attorney, Agent, or Firm* — Oliff & Berridge, PLC

(57) ABSTRACT

An ambidextrous mitt is provided with one of two opposing walls having, over its entire outersurface, means for fastening a removable layer orpad. The removable layer or pad is intended to provide treatment and is designed to ensure thermal and mechanical protection of the part of the hand coming in contact with saidwall. The one wall is connected to the other of two opposing walls by seams. Delimiting pockets are provided for receiving the hand and the thumb.

The one wall includes layers giving it the shape of a semi-flexible wafer, while the other wall is made of an elastic textile shaped with an inflating agent to form the pockets.

8 Claims, 3 Drawing Sheets

Pl. 1/3

AMBIDEXTROUS MITT FOR TREATING A SURFACE

BACKGROUND

The invention relates to a glove for treating a surface, said glove having a wall coming in contact with the inner face of the hand, namely the palm of the hand, and a wall covering the outer face of this hand, namely the back of the hand.

The prior art provides numerous gloves one of whose walls, generally that applied to the palm of the hand, is provided with fastening means able to cooperate with complementary means disposed on the back of a replaceable pad designed to treat a surface to sand, polish, clean, or glaze it. This is the case in references FR 2242044, FR 2588728, GB 2,368,776, GB 2,260,889, and U.S. Pat. No. 3,748,792.

In reference FR 2864751, the applicant remedied certain defects in these treatment gloves by adding means of thermal and/or mechanical protection in the glove wall that receives, on one side, the replaceable treatment pad and, on the other side, the support of the hand.

This enabled the product to be launched and other drawbacks to be detected.

In the embodiment chosen and marketed, the glove is a mitt whose lower face has fastening means such as a textile with hooks or spurs, while the pad is formed of a layer with a facing on one side for the desired scraping, polishing, cleaning, or massage function and a loop-type textile on the other side participating in fastening to the hooks or spurs on the mitt.

With this arrangement, from one and the same mitt, various functions can be carried out by changing the nature of the facing and hence of the replaceable pad which covers the entire surface of the mitt. This range of functions is combined with an assortment of mitt dimensions matching the usual glove sizes and an assortment of different mitts for right-handed or left-handed wearers. There is consequently a large number of replaceable pads to be manufactured, stocked, and offered for sale, adding a constraint to distribution management that slows down and even impedes marketing of the product.

This constraint cannot be reduced by making replaceable pads in smaller dimensions or shapes adapted for universal fastening to all mitt types because, first, movements of the glove on the surface to be treated may cause the edges of the pad to catch on rough spots or level changes in the surface and, second, exposure of the hand by the pad may cause it to burn in the area of the mitt not covered by this removable element.

It should be recalled here that, in addition to improving sanding, polishing, or massage, this type of glove sets out to eliminate all burns or injuries to the hand by excessive rubbing of the skin on the walls of the glove and the surface to be treated.

SUMMARY

The object of the present invention is to overcome these various drawbacks by supplying an ambidextrous mitt that improves protection of the hand while being usable by both right-handed and left-handed individuals, the shape of which mitt can cover a broader size range.

For this purpose, in the ambidextrous mitt according to the invention, the wall having the means for fastening the removable pad is composed of layers conferring on it the shape of a semi-flexible wafer, while the other wall is made of an elastic textile shaped with an inflating agent to form pockets for receiving the hand and thumb, whether right or left.

With this semi-flexible wall structure, which hence has limited deformability, combined with a deformable wall and already having pockets, when the hand is inserted into the glove the asymmetric deformation occurs only on the side of the elastic wall forming the pockets, while in all the gloves with flexible walls, described in the prior art, for example in references U.S. Pat. Nos. 1,782,502, 6,145,155, and CH 682207, the deformation is symmetrical. As a result of the semi-flexibility, the wall has sufficient flexibility for the hand to follow shape variations in the surface being treated, for example in a sanding movement, while its semi-rigidity better distributes the force applied by the hand to the surface of the mitt coming in direct contact with the surface to be treated.

The presence of the semi-flexible wall also enables the relative positions of the areas linking the two walls to be modified without affecting the treatment conditions.

According to a preferred embodiment of the invention, the mitt is made in three sizes, from a single stack of cut-out blanks of each of the layers of which the semi-flexible wall is made, namely:

- a standard size, in which the layers of the semi-flexible wall are attached to the layer of the other wall by a peripheral seam,
- a small size, in which an additional seam is made in the same stack of layers, along and inside the peripheral seam, to reduce the volume of the central and side pockets, respectively,
- and a large size made by replacing the single layer opposite the semi-flexible wall by a larger-sized layer which is attached to the layers forming the semi-flexible wall by a seam, but forming roomier pockets and a larger opening for insertion of the hand.

Thus, the same mitt can be used by right-handed and left-handed individuals, and on hands of different sizes. The shape of the mitt enables it to fit all current sizes with only two or three models. As a result, the number of removable pad models is considerably reduced, and there are no more constraints on inventory and presentation management that could impede distribution of this product.

BRIEF DESCRIPTION OF DRAWINGS

Other features and advantages will emerge from the description hereinbelow with reference to the schematic drawings attached representing one embodiment of this ambidextrous mitt.

DETAILED DESCRIPTION OF EMBODIMENTS

From the description that follows, it will be considered that lower wall F of the mitt cooperates with a removable pad N, because this is the most frequent case, but obviously it could also be the upper wall S for certain applications.

Figure 1:
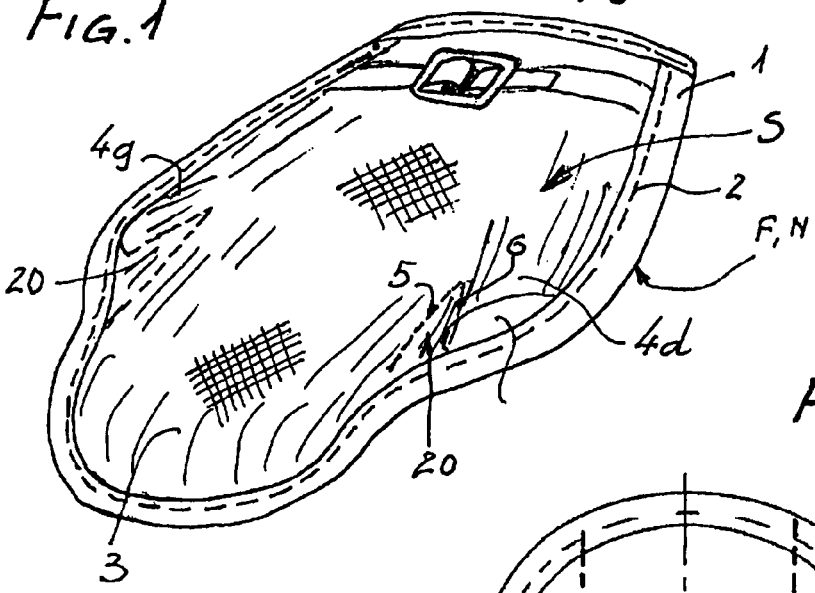
FIG. 1 is a perspective view of one mitt embodiment.
Figure 2:
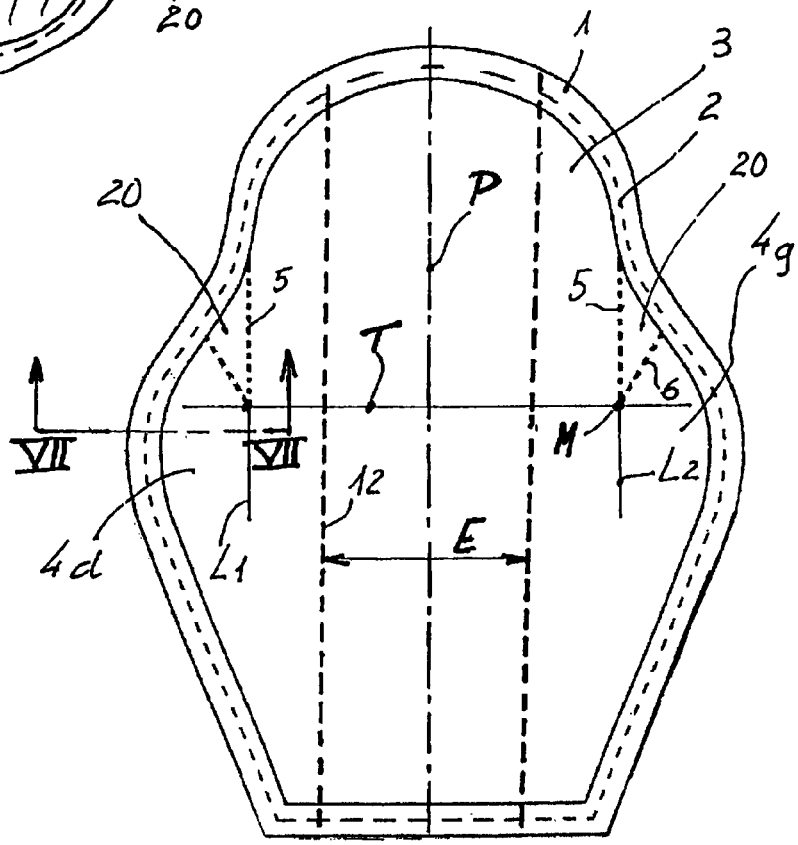
FIG. 2 is an elevation and plan view from above of the inner face of the wall that normally comes in contact with the palm of the hand.
Figure 3:
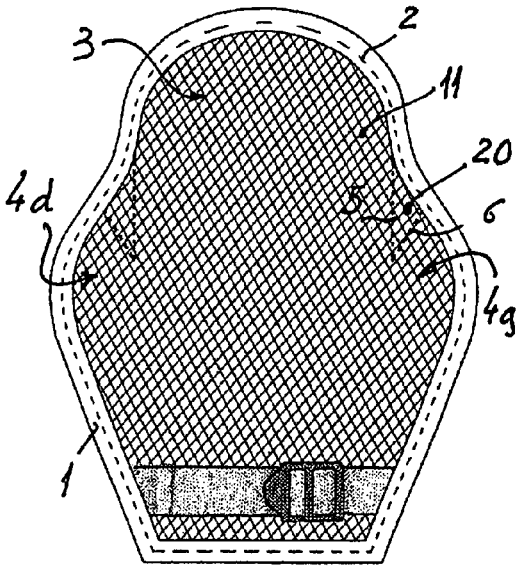
FIGS. 3 and 4 are plan views from above and in elevation, respectively, of the upper wall and the lower wall of this mitt.
Figure 4:
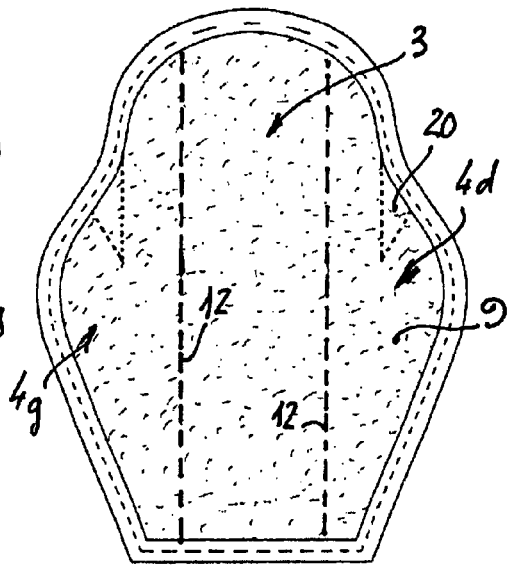

As shown in FIGS. 1 and 2, these two walls are cut out and joined by peripheral seam 2, with interposition of an edge trim 1 and application of the inflating agent to wall S to form a mitt which comprises:

a lobe-shaped center pocket 3 delimited by parallel longitudinal lines L1 and L2, and two side pockets 4*d* and 4*g* forming small lobes disposed symmetrically relative to the longitudinal median plane P of the mitt.

Each of the side pockets 4*d* and 4*g* is physically separated from center pocket 3 by two seams 5 and 6 connecting the two walls F and S. Seam 5 is disposed on the corresponding line L1 or L2 and extends upward from a point M to the edge of the mitt. Point M is disposed at the intersection between line L1 or L2, defined above, and a transverse line T located approximately half-way up the mitt.

Seam 6 leaves from point M and extends upward and sideways to form with seam 5 an angle a of 15 to 45 degrees, for example 30 degrees. This angle a opens upward and sideways, as shown in FIG. 2.

Figure 5:
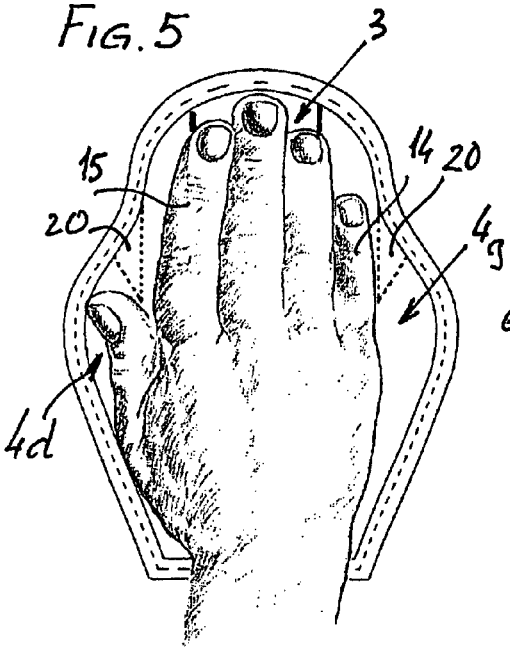
FIGS. 5 and 6 are views of the mitt from which the upper wall has been removed to show how a right hand and a left hand, respectively, are positioned.
Figure 6:
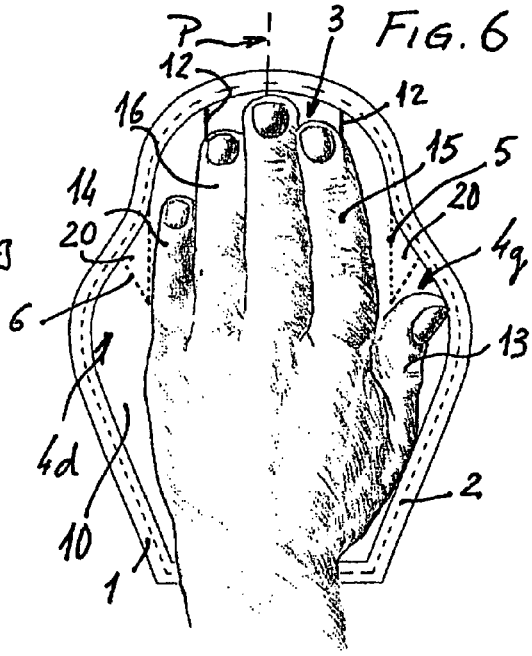

These seams delimit, on each side of the main pocket 3, a separator 20 which, when the hand is inserted into the mitt, participates in distributing the fingers, as shown in FIGS. 5 and 6. Whether on the hand of a right-handed or left-handed person, the thumb 13 fits well into side pocket 4*g* or 4*d*, while all the other fingers go into the center pocket.

Moreover, as clearly shown in these figures, during insertion the little finger 14 is directed, by the wedge shape of separator 20, into center pocket 3 so that it does not become blocked in the free side pocket, which is longer than the little finger.

Figure 7:
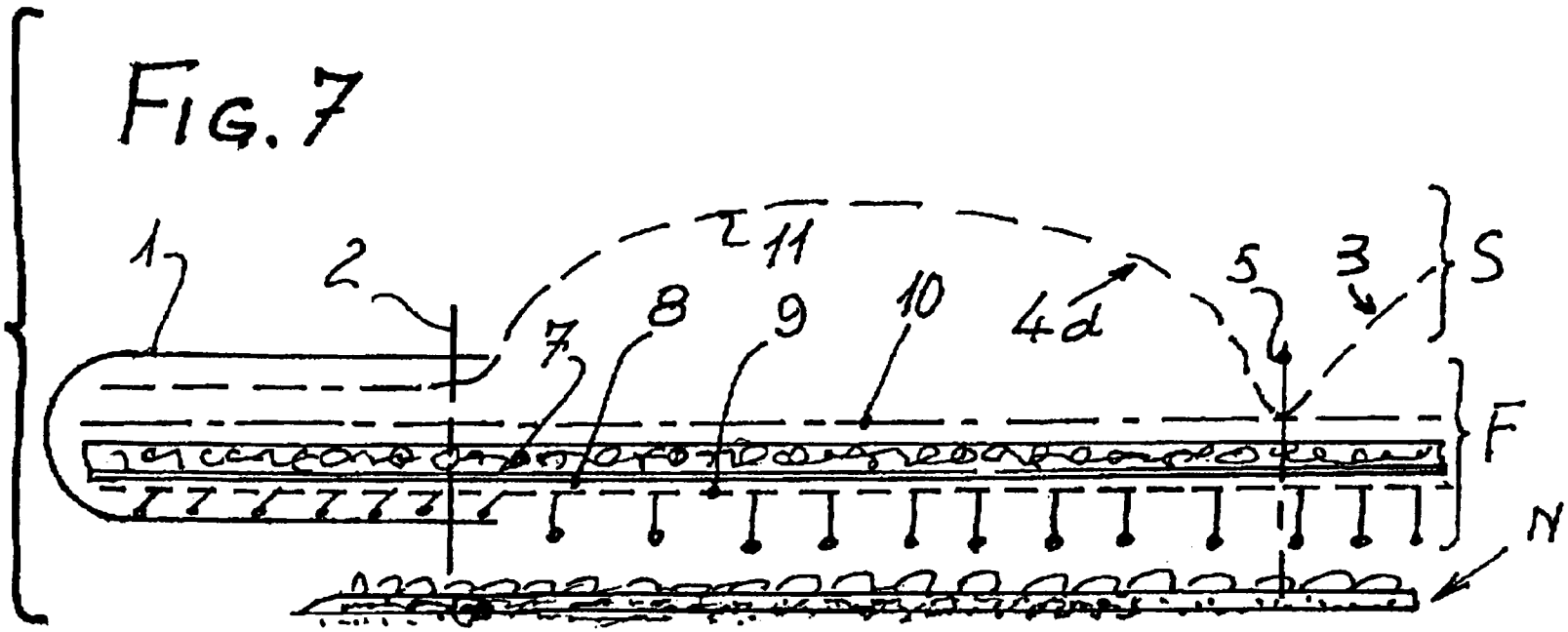
FIG. 7 is a partial cross-sectional view along line VII-VII in FIG. 2, showing an example of the wall structure on an enlarged scale.

FIG. 7 shows in partial section one embodiment of walls F and S of which the mitt is composed. The lower wall F is composed of a core 7 made of insulating material, such as a synthetic foam. This material is chosen to have some rigidity or semi-flexibility such as to offer bending resistance. The latter is also reinforced by a layer 8 of mechanical protection, by the outer layer 9, which has out-facing hooks or spurs, and by a comfortable inner layer 10 made of a non-slip textile, for example a nonwoven textile.

Inner layer 10 is glued to core 7 over its entire surface so that, when the hand moves to move the mitt relative to the surface to be treated, there is no movement of the hand relative to the layer, as would be the case if the layer were free-floating. This prevents any slippage and movements of the hand that could create premature wear of the layer and discomfort or injury to the hand.

The upper wall S is made of an elastic layer 11 of honeycomb fabric, known as 3D, whose cells are open, namely permeable to gas exchanges between the inside and outside, to contribute to carrying away heat and perspiration.

All the layers of lower wall F are connected to each other and to layer 11, constituting upper wall S, by the peripheral seam 2 and by seams 5 and 6 forming side pockets 4*d* and 4*g*.

It will be noted that, when the layers are joined together by the seams, some bulk is conferred on layer 11, namely a larger surface of layer 11 builds up on the stack of layers constituting wall F underneath, which then forms a type of flat wafer. Seams 2, 5, and 6 increase the rigidity of wall F still further although, when in use, it can still bend to match the shape variations of the surfaces to be treated.

FIG. 2 shows that the elements of lower wall F are also joined by two parallel longitudinal seams 12 extending over the entire length of this wall whose spacing E is determined so that they are below index finger 15 and ring finger 16, respectively.

These seams 12 have several functions; in particular:

offer the option of transverse deformation of the lower wall F when this is too rigid to match a convex surface, when the hand is inserted into the mitt, form two channels contributing to evacuation of heat and perspiration, and on the inner face and inside the mitt, delimit grooves for positioning index finger 15 and ring finger 16, improving the connection between hand and mitt and preventing all relative movements that would create discomfort and burns.

By their nature, layers 7 to 10, due to their lamination and various methods of assembly (gluing, stitching, and interpenetration of loops and hooks or spurs) form a semi-flexible semi-rigid structure that offers tactile sensitivity and enables the reactions generated by the treated surface to be conveyed to the hand as treatment proceeds. For example, when sanding a surface, the operator perceives the presence of bumps or projections without having to stop and look for them, by sweeping the surface with his hand.

In addition, this same semi-flexible feature combined with semi-rigidity distributes the force exercised by the hand over the entire surface of the pad in contact with the surface to be treated, and not just the parts in contact with the fingers, as is the case with the flexible-walled gloves described in the prior art. As a result, there is better utilization of human effort and improvement of the treatment, for example sanding or polishing.

The mitt is made in three sizes, from a single cut-out blank of each of the layers 7 to 10 of which the lower wall is made, namely:

a standard size, in which the layers 7 to 10 are joined to layer 11 by peripheral seam 2, as shown in the figures; because of the elastic deformation of layer 11, this size accepts glove sizes from 8 to 10, a small size, in which an additional seam is made along and inside the peripheral seam 2, to reduce the volume of the center pocket 3 and side pockets 4*g* and 4*d*, respectively, and a very large size made by replacing the single layer 11 by a larger-sized layer which is attached to the components of lower wall F by seams 2, 5, and 6, but forming roomier pockets and a larger opening for insertion of a larger hand.

This combination covers about 95% of the usual glove sizes, and has the advantage of reducing the number of sizes of removable pads N that have to be stored for each of the different models, such as sanding pad, polishing pad, cleaning pad, massage pad, etc.

The ambidextrous nature of the mitt also enables it to be turned around on the hand to bring the fastening layer 9 to the top of the hand in order to treat a surface with too small a radius of curvature to be treated by the palm, but treatable with the back of the hand.

Of course, it would not be a departure from the framework of the invention to replace, in alternative embodiments, sewn seams by heat-welding, high-frequency welding, or other forms of welding, or by glue lines.

Also, the pockets may have any shape different from those described above, for example being formed in a large rectangular pocket if the separation between the center pocket and the side pockets is effected by the separators defined above.

The invention claimed is:

1. An ambidextrous mitt for treating a surface, comprising:

a first wall and a second wall for covering a front and back of a wearer's hand during use, wherein the first wall has an outer face which faces away from the hand of the wearer when worn and is completely covered by a fastening mechanism, the fastening mechanism provides a means for fastening at least one of a removable layer or pad to the mitt to provide treatment to a surface, the at least one of the removable layer or pad being configured to provide thermal and mechanical protection to a part of the hand of the wearer coming into contact with the first wall, wherein the second wall is connected to the first wall by seams, the second wall delimiting separate pockets including a center pocket for receiving the hand of the wearer and a plurality of side pockets for separately receiving a thumb of the hand of the wearer, wherein the first wall that includes the means for fastening is composed of fabric layers giving the first wall a shape of a semi-flexible wafer, and wherein the second wall is made of an elastic textile honeycomb fabric that renders the second wall more flexible than the first wall, the elastic textile honeycomb fabric is shaped to form separate pockets.

2. The mitt according to claim 1, wherein a relative rigidity of a layer constituting a core of the first wall confers semi-flexibility on the first wall.

3. The mitt according to claim 1, wherein the first wall has, on an inner face, a non-slip layer that provides a non-slip surface for the hand of the wearer, the non-slip layer being glued over an entire surface to a layer of the fabric layers.

4. The mitt according to claim 1, wherein the first wall is traversed by two parallel longitudinal seams joining the fabric layers of the first wall and extending over an entire length of the first wall, a spacing between the two parallel longitudinal seams being determined so that the two parallel longitudinal seams come under an index finger and a ring finger of the hand of the wearer inserted into the mitt.

5. The mitt according to claim 1, wherein different sizes are provided from a single cut-out blank of each of the fabric layers of the first wall.

6. The mitt according to claim 5, wherein a standard size is formed with the fabric layers of the first wall being joined to the second wall by a peripheral seam.

7. The mitt according to claim 5, wherein a large size is formed by using a larger-dimension layer which is attached to the fabric layers of the first wall by seams to form roomier pockets and a larger opening for insertion of the hand of the wearer.

8. The mitt according to claim 6, wherein a small size is formed with an additional seam in the fabric layers of the first wall along and inside the peripheral seam, to reduce a volume of the center pocket and the plurality of side pockets, respectively.

* * * * *